United States Patent [19]

Johnston

[11] 4,120,174

[45] Oct. 17, 1978

[54] AIR DEFROST DISPLAY CASE

[75] Inventor: William C. Johnston, Atlanta, Ga.

[73] Assignee: Kysor Industrial Corporation, Cadillac, Mich.

[21] Appl. No.: 778,216

[22] Filed: Mar. 16, 1977

[51] Int. Cl.[2] ..... A47F 3/04; F25B 29/00

[52] U.S. Cl. ..... 62/256; 62/325

[58] Field of Search ..... 62/256, 282, 80, 325, 62/428, 429

[56] References Cited

U.S. PATENT DOCUMENTS

| | | | |
|---|---|---|---|
| 2,724,247 | 11/1955 | Kurtz | 62/325 |
| 3,063,256 | 11/1962 | Lamb | 62/256 |
| 3,094,851 | 6/1963 | Beckwith | 62/256 |
| 3,226,945 | 1/1966 | Spencer | 62/256 |
| 3,543,532 | 12/1970 | Gatton et al. | 62/256 |
| 3,850,003 | 11/1974 | Beckwith et al. | 62/256 |
| 4,026,121 | 5/1977 | Aokage et al. | 62/256 |

FOREIGN PATENT DOCUMENTS

| | | | |
|---|---|---|---|
| 2,123,646 | 11/1972 | Fed. Rep. of Germany | 62/256 |

*Primary Examiner*—Lloyd L. King

*Attorney, Agent, or Firm*—Price, Heneveld, Huizenga & Cooper

[57] ABSTRACT

An open-type air defrost refrigerated display employing recirculatory refrigerated air flow for cooling, and reverse air flow into the ambient and from the ambient for defrost, there being a return air grille opening which is bioriented, with portions oriented to receive recirculatory cold air flow from across the display access opening during refrigeration, and portions oriented to discharge reverse flow defrost air into the ambient during defrost. These second portions are aerodynamically aligned with the adjacent passage from whence the reverse flow defrost air flows.

The passage means preferably includes, between the refrigeration coil and the refrigerated air outlet, damper means for restricting the recirculatory refrigerated air flow a controlled amount, while allowing unrestricted reverse defrost air flow therethrough.

11 Claims, 12 Drawing Figures

AIR DEFROST DISPLAY CASE

BACKGROUND OF THE INVENTION

This invention relates to refrigerated display cases, and more particularly to air defrost refrigerated display cases employing reverse air flow defrost.

In recent times, concentrated research efforts to conserve valuable and increasingly expensive energy have resulted in a search for defrost capacity using other than the usual electrical defrost or hot refrigerant gas defrost due to the cost of these latter two. As a result, certain air defrost developments have occurred, one of the most advantageous of which is of Japanese origin and which employs reverse air flow through the recirculatory air passage system for defrost operation. This is set forth in U.S. Patent Application Ser. No. 686,895, filed May 17, 1976 and entitled DEFROSTING IN OPEN SHOW CASE OF COLD-AIR-CIRCULATION TYPE, now U.S. Pat. No. 4,026,121, corresponding to published Japanese Patent Application No. 59,908/1975 filed May 20, 1975.

The present invention employs reverse flow air defrost in a special manner with a unique construction, rendering it particularly suitable for open top chest cases.

SUMMARY OF THE INVENTION

The present invention employs this reverse air flow concept in combination with unique features achieving more efficient and rapid defrost to minimize product temperature rise during the defrost mode.

The novel structure enables reverse air defrost to be particularly employed for open top chest type display cases.

The novel structure causes controlled recirculatory cold air flow during the refrigeration mode, and uninhibited nonrecirculatory reverse defrost air flow to and from the surrounding ambient air during defrost. It uses a special bioriented return grille opening, and preferably employs a differential flow control damper.

DESCRIPTION OF THE PREFERRED EMBODIMENT

Figure 1:
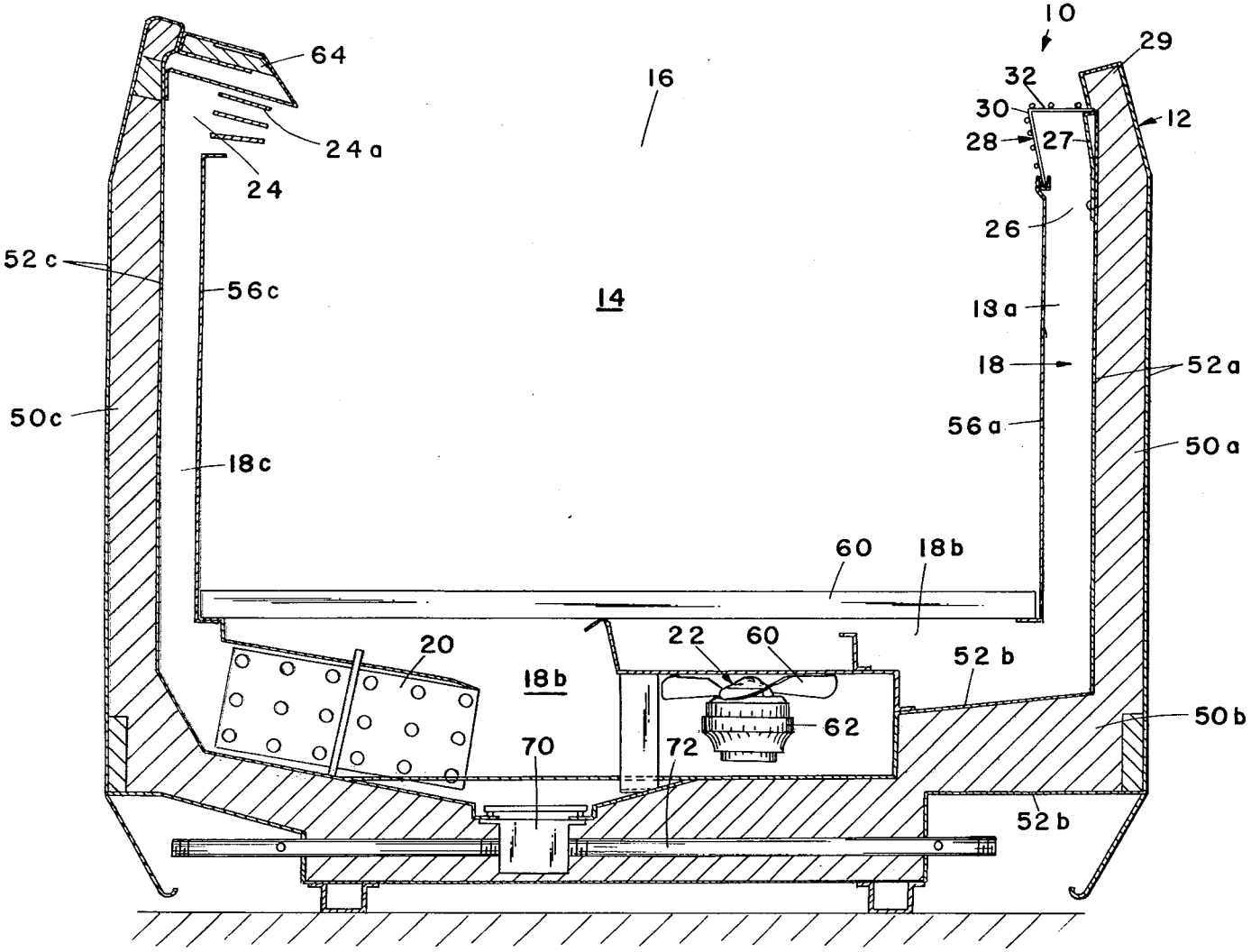
FIG. 1 is a sectional elevational view of a refrigerated chest-type display having an open top and employing the invention.
Figure 3:
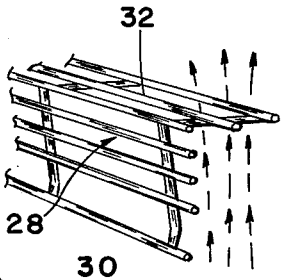
FIG. 3 is a fragmentary perspective view of a portion of the return grille in FIG. 2.
Figure 2:
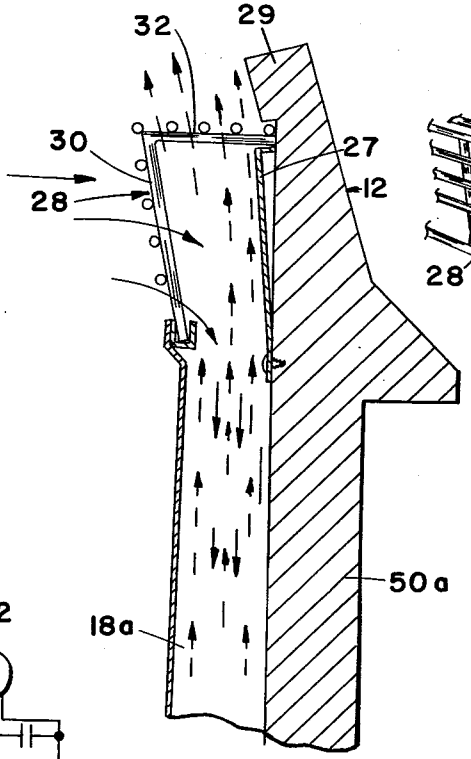
FIG. 2 is a fragmentary sectional elevational view of the return grille portion of the apparatus in FIG. 1.

Referring now specifically to the drawings, the refrigerated display 10 set forth to illustrate the invention incorporates a cabinet 12 defining a product storage and display space 14 with an access opening 16 thereto. Cabinet 12 extends around three sides of display space 14 with the fourth side being open for opening 16. The cabinet has air passage means 18 in which a refrigeration evaporator coil 20 and air propelling means 22 are located for propelling recirculatory cold air through said passage in one direction for refrigeration, and for propelling nonrecirculatory ambient air in the opposite direction for defrost, as explained in more detail hereinafter. Air passage means 18 terminates in an air discharge outlet 24 and outlet nozzle **24*a* directed across the open side formed by access opening 16, toward the air return inlet 26** to the passage means. The discharge and inlet are elongated, extending substantially the length of the display space.

Across the inlet 26 is a special air return grille 28 which is bioriented, having a first portion 30 directed toward outlet 24 across the open side of the display to receive the cold recirculatory return air flow from outlet 24 across the open space 16 during normal refrigeration operation. Grille 28 also has a second portion 32 oriented toward the ambient atmosphere for direct discharge of reverse flow warm defrost air from port 26 into the ambient atmosphere and not toward the opening 24 on the opposite side of the display. Portion 32 is in aerodynamic alignment with the adjacent passage portion **18*a* of passage means 18. Passage portion 18*a* extends along one wall of the display space 14, joining passage portion 18*b* in which is located air propelling means 22 and refrigeration coil 20, and which communicates with passage portion 18*c* extending to outlet port 24**.

Figure 7:
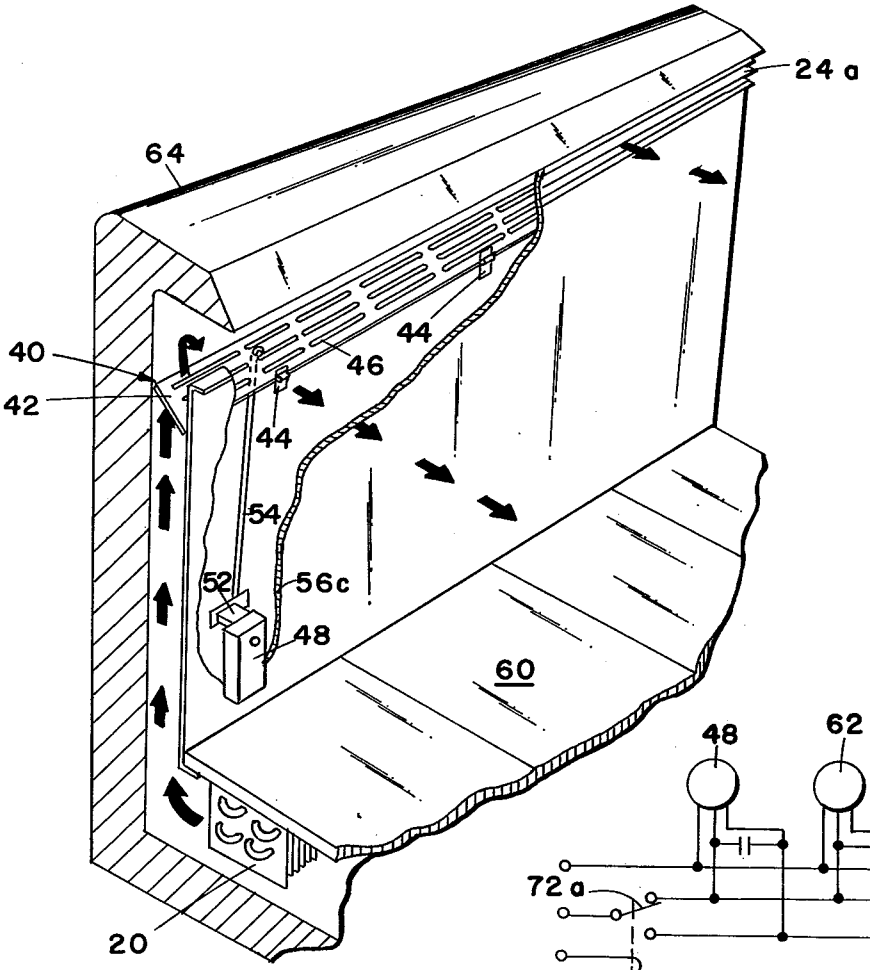
FIG. 7 is a fragmentary perspective view of the apparatus in FIGS. 5 and 6.
Figure 6:
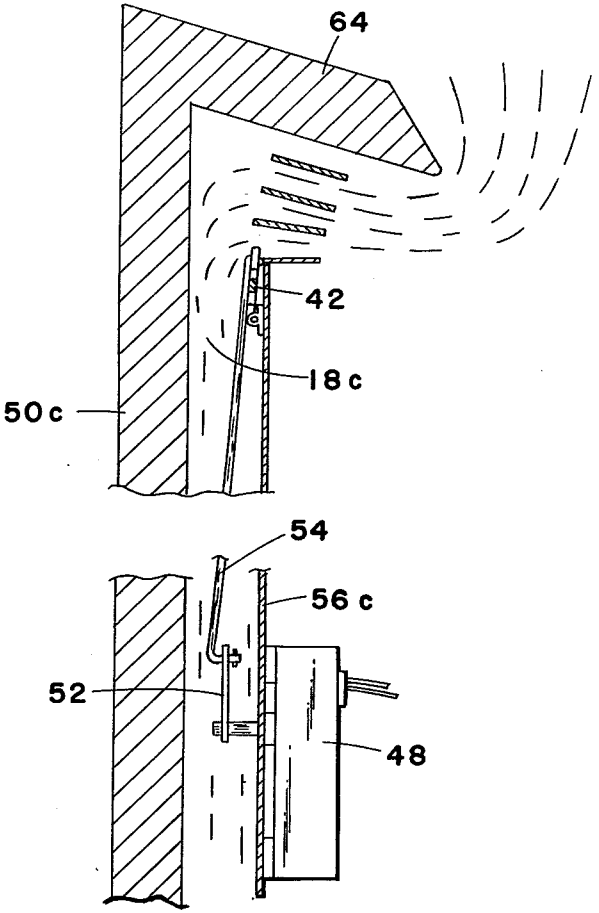
FIG. 6 is a sectional view of the apparatus in FIG. 5 with the damper shown in the unrestricted flow position for defrost.
Figure 5:
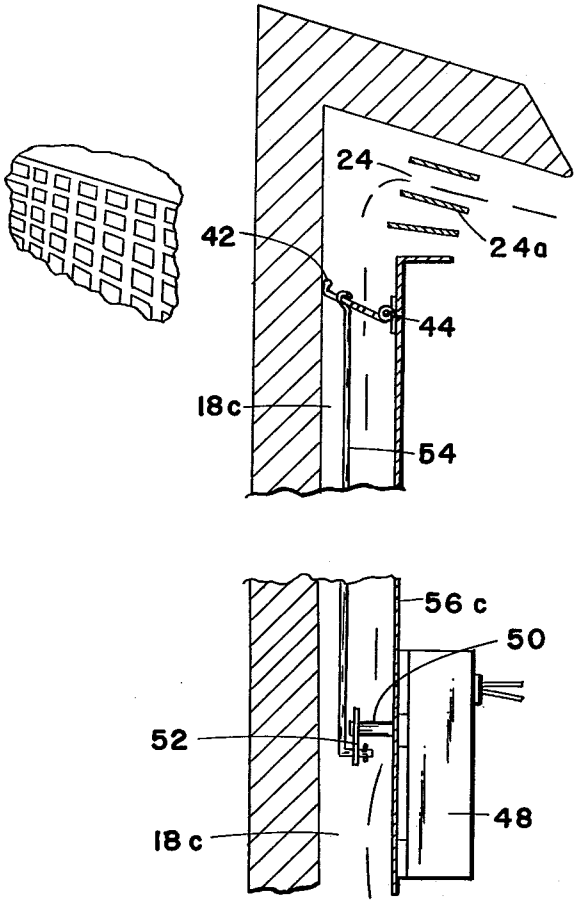
FIG. 5 is a fragmentary enlarged sectional view of the refrigerated air outlet and adjacent passage and damper, the damper being shown in its restricted flow position.

Within passage portion **18*c* is preferably mounted a differential air flow control. This is shown as a shiftable damper assembly 40 in FIGS. 5, 6 and 7. This damper assembly 40 includes an elongated baffle plate or damper 42, shiftable between a controlled restricted flow condition across passage portion 18*c* (FIG. 5) and an unrestricted flow position alongside a wall of and not across passage 18*c* (FIG. 6). Baffle 42 is shown mounted to the passage wall by hinges 44 at spaced intervals along the length of the elongated baffle to allow it to be pivotally shifted. This baffle is orificed, containing a plurality of openings 46 therethrough, here shown as a series of elongated slots. When the baffle is positioned across the passage, air flow is restricted to these slot openings. Baffle 42 is shifted between its two positions by a suitable actuator such as an electrically operated damper motor or rotary solenoid 48 which rotates its output shaft 50 a controlled amount to thereby shift crank 52, attached to shaft 50, through a controlled arc. This crank shifts damper actuating rod 54 linearly, with one end of rod 54 being attached to crank 52, and the other end being attached to baffle 42**.

The chest-type display case depicted has its access opening 16 on the top, with the enclosed three walls of the display space 14 being on the opposite two vertical sides, i.e. the "front" and "rear", and across the bottom. The ends of the case are closed in typical fashion. The side walls include a pair of external insulation panels 50a at the front, 50c at the rear, and 50b at the bottom of the case, enclosed within respective pairs of liners 52a, 52b and 52c. Passage 18a is formed between inner liner 52a and an inwardly spaced interior panel 56a. Passage 18c is formed between inner liner 52c and an inwardly spaced panel 56c. Passage portion 18b is basically formed between the overlying deck pans 60 at the bottom of display space 14, and the inner liner of the pair of liners 52b encompassing insulation panel 50b.

Air propelling means 22 within bottom passage portion 18b constitutes a series of fans 60 spaced along the length of the case, mounted on and operated by reversible electric motors 62. Duct portion 18b is constructed so that all of the air must flow past these fans. Also contained in bottom passage portion 18b downstream of the fans, relative to the air flow direction on refrigeration mode, is the evaporator coil structure 20, the ducts being constructed such that all of the air must flow through this coil.

The bottom of the cabinet also contains typical drain 70 and conduits 72 for discharge of melted frost during defrost mode.

Overlying air discharge port 24 is a horizontally extending display rail 64, with the underlying port 24 and nozzle element 24a being oriented generally horizontally across the top opening 16, i.e. normal to the vertically oriented passage portions 18c communicating therewith. Portion 30 of air return grille 28 on the opposite side of the display extends generally vertically so that the openings therein collectively face horizontally across the open top toward discharge 24. The second portion 32 of discharge grille 28 extends horizontally such that the series of openings formed therein collectively face vertically upwardly, causing reverse air flow up through passage portion 18a to flow directly through these openings and up into the ambient atmosphere rather than toward the opposite side of the display. This grille is formed of a series of elongated smoothly configurated, preferably circular cross section rods extending parallel to each other and interconnected by transversely oriented like shaped rods. This particular type of construction is selected due to its minimal resistance to air flow during defrost mode.

This return grille should have certain characteristics. Specifically, it must prevent ingress of product packages into the return air flue during normal usage of the fixture. Secondly, during defrost mode, it must not direct the defrost air across the open top towards the opposite side of the display, i.e. toward the usual discharge nozzle. Thirdly, it should, as noted previously, possess minimum resistance to flow, i.e. must not possess undue resistance to flow to enable effective reverse flow of defrost air. And, fourthly, it must satisfy the usual refrigeration mode requirements as a return grille. This grille is in contrast to the prior art.

Figure 4:
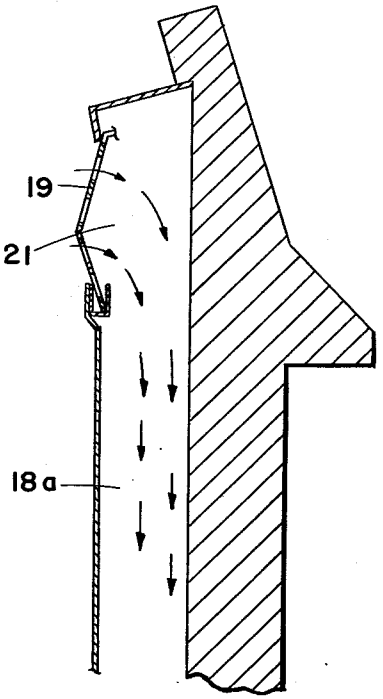
FIG 4 PRIOR ART
FIG. 4 is a fragmentary enlarged sectional view of the prior art return grille.
Figure 12:
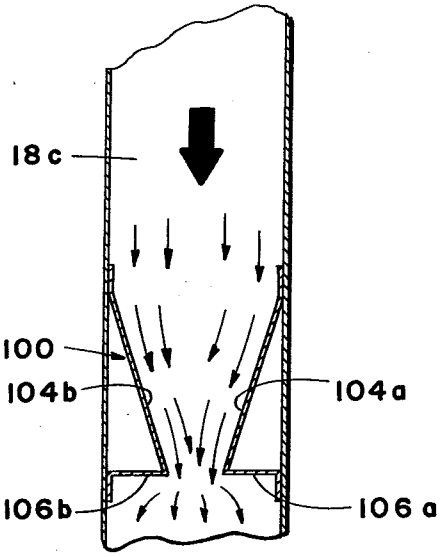
FIG. 12 is the unit in FIG. 11 during defrost flow.
Figure 11:
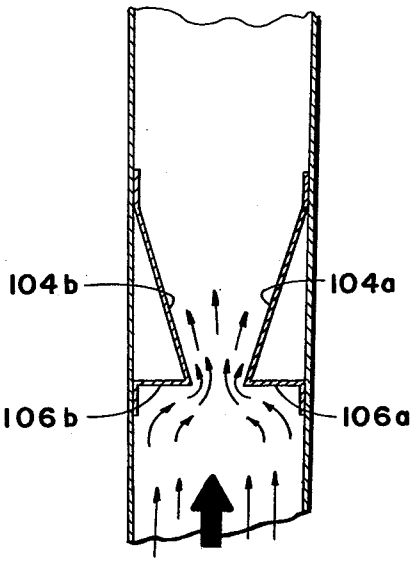
FIG. 11 is an enlarged fragmentary, sectional view of the flow control unit during refrigeration flow.
Figure 10:
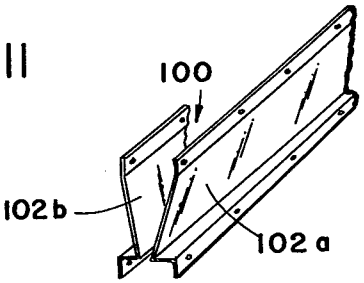
FIG. 10 is a fragmentary perspective view of the differential flow control unit in FIG. 9.

FIG. 4 depicts a typical prior art type of return air grille where, at the top of passage 18a a flat metal grilled 19 and its adjacent inlet 21 are oriented across the opening toward the discharge on the opposite side of the display.

To assure smooth discharge of defrost air from port 27 and grille portion 32 up into the ambient air, an adapator diverter plate 27 can be mounted at the front wall of passage 18a to prevent air flow disruption by rub rail 29 on the top of the front wall.

It is definitely desirable to have the reverse flow of air during defrost at a greater flow capacity than during refrigeration. Thus, the air propelling means or fans are purposely caused to have a disparate flow capacity in forward and reverse operation, refrigeration to defrost, preferably in the ratio of approximately 1.0:1.5 or more. It is desirable to have high volume air flow movement during defrost for maximizing defrost operation and minimizing the defrost time period. However, rapid and massive air flow during the refrigeration mode is disruptive of the flow pattern of refrigerated air. To optimize these requirements, the air propelling fans have this disparate mass flow capacity in the two different directions such that flow in one direction, during defrost, is significantly greater than flow in the opposite direction, for refrigeration.

Also, the special damper or baffle means 42 is preferably provided in the air passage means to further assist in effecting disparity in mass flow rates, directly and also by enabling more fan units to be employed. During defrost, this baffle is shifted out of the passage, alongside the liner wall, to allow uninhibited flow of warm ambient defrost air therepast, while during the refrigeration mode, it extends across passage 18c to restrict air flow to a controlled amount. This shift can be caused to occur automatically through the use of a control mechanism that also automatically shifts the fan motors in reverse for defrost mode. The use of the damper allows a larger number of reverse flow fans/motor assemblies than usual, to supply sufficient pressure rise for adequate air flow rate to the refrigeration nozzle during refrigeration, while during defrost, the open damper reduces the duct resistance and allows the full effect of the increased number of fans for enhanced defrost air mass flow rate. Placement of the damper grid downstream of the coil relative to the refrigeration mode air pass is to prevent the damper becoming plugged with frost as would tend to occur if it were in front of the coil under some store conditions. Being downstream of the coil, and with the moisture being largely removed from the cold air at the coil during refrigeration the damper will be exposed to only relatively dry air.

Figure 8:
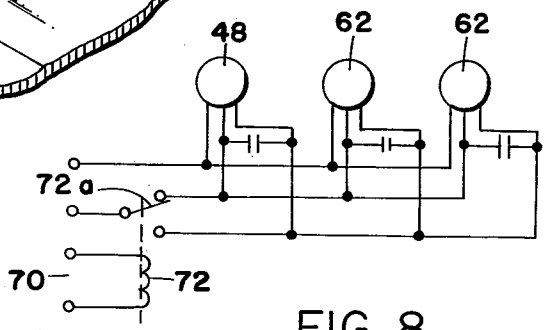
FIG. 8 is an electrical diagram of a simplified control circuit for the apparatus.

A suitable control circuit such as the simplified one depicted in FIG. 8 can be employed for the apparatus. Specifically a timer 70 connected to a relay 72 causes relay switch 72a to reverse the rotation of the plurality of fan motors 62 and operate damper motor 48 to open passage 18c for nonrecirculatory defrost air flow, and at the end of the defrost period, to cause rotation of fan motors 62 forwardly and shift the damper over passage 18c for recirculatory refrigeration air flow. The recirculatory refrigeration air flow is depicted by solid line arrows in the drawings. The nonrecirculatory ambient air flow for defrost is shown by dashed line arrows, the warm relatively dry air being drawn out of the surrounding warm ambient air into nozzle 24a and port 24, through passage 18c, through coil 20 where it melts the frost, through fans 60, passage 18b, passage 18a, and out the upper portion 32 of grille 28 up into the ambient air of the store so that this cooler, wetter air is not recirculated nor disturbing to the cold air pool in product display space 14.

Figure 9:
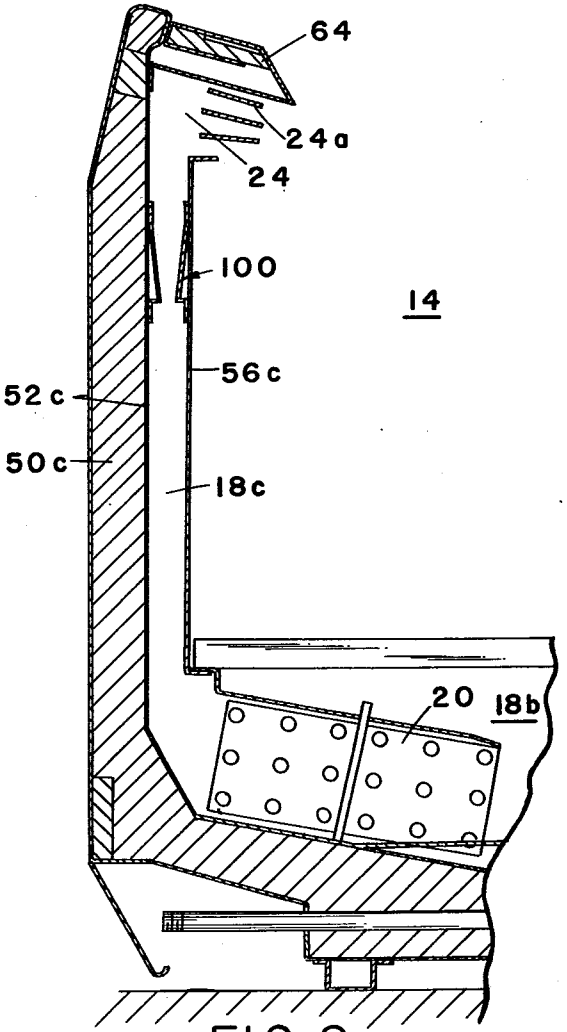
FIG. 9 is a sectional elevational view of a refrigerated chest-type display employing a different form of differential flow control.

A second form of differential flow control unit is depicted in FIGS. 9–12, such being fixed in the passage rather than shiftable. Referring to FIG. 9, the display 10 is generally like that in FIG. 1 with components thereof being indicated with like numbers except for flow control 100. Flow control 100 is mounted in passage 18c, downstream of the coil relative to the air flow during the refrigeration mode. It is elongated to extend the full length of passage 18*c* from end to end of the display case. The unit is formed of two mirror image metal elements 102*a* and 102*b* (FIG. 10) attached to opposte walls of passage 18*c* in a fashion to present a smoothly tapered, venturi-like, convergent throat to warm air flow during reverse defrost flow (FIG. 12) for minimizing flow resistance thereof. This throat is formed by smoothly converging, tapering panels 104*a* and 104*b*. In contrast, the air flow in the opposite direction during the refrigeration mode (FIG. 11) is relatively restricted by encountering a pair of blunt transverse panels 106*a* and 106*b* forming an elongated slot orifice between them through which the flow must occur. The smoothly tapered walls 104*a* and 104*b* foster an orderly flow with less flow resistance and greater flow rate while the blunt transverse panels foster disorderly flow with greater flow resistance and reduced flow rate. The result is a disparate or differential flow. The flow resistance would be approximately 0.9 during reverse defrost flow and approximately 0.55 during forward refrigeration flow, yielding a ratio of about 1.4 or so. More than one such device can be mounted in series in the passage if desired. The location downstream of the coil, relative to the flow direction during refrigeration, precludes frost accumulation and associated flow blockage effects.

The embodiments of the invention in which an exclusive property or privilege is claimed are defined as follows:

1. A chest-type ar defrost refrigerated display operable in a refrigeration mode and a defrost mode, comprising:

a storage chest having an open top, a refrigeration coil, and recirculation air flow passage means for recirculating cold air from said open top to said coil and back to and across said open top during the refrigeration mode, said passage means including a refrigerated air outlet opening at one side of said open top and oriented for air flow therefrom in a direction across said open top, and an air return opening at the opposite side of said open top having a biorientation including portions oriented to receive return air flow across said open top from said refrigerated air outlet opening during the refrigeration mode, and other portions oriented to discharge reverse defrost air flow from said passage means into ambient air during the defrost mode; and two-way air propelling means arranged to so recirculate cold air in one direction through said passage means in the refrigeration mode, and to cause defrost air flow from the ambient air, in the reverse direction through said passage means, and out said bioriented opening to the ambient air during the defrost mode, the defrost air flow in said reverse direction through said passage means being greater than refrigeration flow in said one direction.

2. An air defrost refrigerated display having product storage space with an access opening, a refrigeration coil, and air passage means and air propelling means for recirculating cold air across said coil and across said access opening; said air propelling means being operable to so recirculate cold air in one direction during refrigeration, and to propel defrost air in the reverse direction during defrost operation, the defrost air flow in said reverse direction being greater than refrigeration flow in said one direction, said air passage means including an air return at one side of said access opening and having a biorientation structure with first portions oriented to receive recirculated cold air from across said access opening, and other portions oriented relative to said air passage means and relative to said access opening to discharge defrost air into the ambient air.

3. The display in claim 2 having a chest defining said storage space and having said access opening at the top thereof, said air passage means including a refrigerated air discharge outlet directed across said open top toward said air return; said air return first portions being oriented generally horizontally across said open top toward said outlet to receive refrigerated air therefrom, and said other portions being oriented upwardly to discharge reverse flow defrost air up into the ambient air.

4. The display in claim 2 including differential flow control means within said air passage means for restricting air flow therethrough in one direction during refrigeration relative to air flow therethrough in the opposite direction during defrost.

5. The display in claim 4 wherein said differential flow conrol means is shiftable to cause the controlled differential flow in one direction and the opposite direction.

6. The display in claim 4 wherein said differential flow control means is configurated to present an unstreamlined flow surface area for restricted air flow therethrough in one direction during refrigeration, and to present a generally streamlined surface area for low flow resistance and greater defrost air flow therethrough in the opposite direction during defrost.

7. An air defrost refrigerated display having product storage space with an access opening, a refrigeration coil, and air passage means and air propelling means for recirculating cold air across said coil and across said access opening; said air propelling meams being operable to so recirculate cold air in one direction during refrigeration, and to propel defrost air in the reverse direction during defrost operation, differential flow control means within said air passage means for restraining air flow through said air passage means during refrigeration while allowing generally unrestrained reverse air flow through said air passage means during defrost.

8. The display in claim 7 wherein said differential flow control means is shiftable between a first restricting position for so restricting flow during refrigeration, and a second position allowing generally unrestricted reverse air flow during defrost.

9. The display in claim 8 including actuator means for shifting said differential flow control means between said first and second positions.

10. The display in claim 8 wherein said flow dampening means comprises an orificed baffle plate.

11. The display in claim 7 wherein said differential flow control means is configurated to present an unstreamlined flow surface area for restricted air flow therethrough in one direction during refrigeration, and to present a generally streamlined surface area for low flow resistance and greater defrost air flow therethrough in the opposite direction during defrost.

* * * * *

UNITED STATES PATENT AND TRADEMARK OFFICE

CERTIFICATE OF CORRECTION

PATENT NO. : 4,120,174

DATED : October 17, 1978

INVENTOR(S) : William C. Johnston

It is certified that error appears in the above-identified patent and that said Letters Patent are hereby corrected as shown below:

Column 3, line 63:
"27" should be ---26---

Column 5, line 3:
"opposte" should be ---opposite---

Column 5, line 8:
"tapering" should be ---tapered---

Column 5, line 30:
"ar" should be ---air---

Column 6, line 24:
"conrol" should be ---control---

Column 6, line 39:
"meams" should be ---means---

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*